United States Patent [19]

Bori

[11] Patent Number: 4,617,694

[45] Date of Patent: Oct. 21, 1986

[54] FINGER-MOUNTED DEVICE FOR CLEANING TEETH

[75] Inventor: Jacques Bori, Watertown, Mass.

[73] Assignee: Team, Inc., Newton, Mass.

[21] Appl. No.: 652,844

[22] Filed: Sep. 21, 1984

[51] Int. Cl.[4] ..... A46B 9/04

[52] U.S. Cl. ..... 15/167 R; 15/159 A; 15/227; 15/160; 132/84 A; 132/91

[58] Field of Search ..... 15/167 R, 227, 160, 15/159 A; 132/84 R, 84 A, 84 B, 85, 89–93; D4/103, 104, 129

[56] References Cited

U.S. PATENT DOCUMENTS

| | | | |
|---|---|---|---|
| 1,770,426 | 7/1930 | Paris et al. | 15/227 X |
| 2,186,005 | 1/1940 | Casto | 15/167 R |
| 2,396,548 | 3/1946 | Allen | 15/227 X |
| 2,978,724 | 4/1961 | Gracian | 15/106 X |
| 4,292,705 | 10/1981 | Stouffer | 15/227 X |
| 4,338,957 | 7/1982 | Meibauer | 132/93 |

*Primary Examiner*—Peter Feldman
*Attorney, Agent, or Firm*—Herbert S. Kassman

[57] ABSTRACT

A finger-mounted device for cleaning teeth having an improved teeth cleaning surface, pick means for cleaning between the teeth, a nonslip finger-engaging means, and means for providing a length of dental floss. The improved teeth cleaning surface consists of a plurality of concave surfaces joined along their raised edges, each of the concave surfaces being adapted to clean a complimentary shaped convex tooth surface and the raised edges being adapted to clean the tooth edges. The teeth cleaning surface is preferably formed by soft bristles. A pick means comprises a section of hard bristles disposed within the soft bristle area, the distal ends of the hard bristles being tapered to form a point which lies beneath the soft bristle surface, the pick being exposed for cleaning between teeth by applying a greater pressure than that required for brushing the teeth with the soft bristles. The improved finger-engaging means is a tubular holder having both ends open and including an arcuate portion on one edge defining a concave fingertip surface for engaging the palm side of the fingertip to retain the holder on the finger. A length of dental floss is attached at one end to the device and stored around a spool attached to the device, the opposite end of the floss being attached to ring means which is also mounted on the device but detachable therefrom for unwinding the floss from the spool and holding the floss taut between the ring and device in a teeth flossing position.

11 Claims, 2 Drawing Figures

FINGER-MOUNTED DEVICE FOR CLEANING TEETH

FIELD OF THE INVENTION

This invention relates to devices for cleaning teeth, and more particularly to such devices which are mounted on a finger.

BACKGROUND OF THE INVENTION

The toothbrush in common use, consisting of a rigid handle provided with bristles at one end, has a number of recognized disadvantages including an inability to effectively clean the surfaces of all teeth, particularly those at the rear of the mouth, and a tendency to injure the gums by sharp contacting of the gums by the rigid handle.

Many attempts have been made to design a brush structure to be fixed or held upon the finger of the user. Much greater control and flexibility can be achieved when the brush is manipulated by a finger. However, the known finger brushes have a number of disadvantages. Many prior art finger brushes have a closed end finger sheath which does not adapt well to different finger and fingernail lengths. See e.g., U.S. Pat. No. Des. 97,360 (Stevens).

Another disadvantage of many finger brushes is an inability to retain the brush in proper alignment on the finger during brushing. Prior attempts to overcome this problem include providing: an adhesive strip with overlapping ends, U.S. Pat. Nos. 2,921,590 (Holton) and 2,915,767 (Vaughan); a slit through which the fingertip is inserted, U.S. Pat. No. 2,439,056 (Rathbun); a frustoconical finger holder which may be slit and formed of a resilient material, U.S. Pat. No. 2,396,548 (Allen); a ribbed expandable loop together with a fingernail cavity, U.S. Pat. No. 3,105,260 (Smith et al.); and an elastomeric tubular member of uniform inner dimension which is deformable to snugly engage the finger, U.S. Pat. No. 4,251,987 (Alam). Many of these devices are undesirable because of their cost and/or they still do not adequately prevent slippage.

Another disadvantage of prior art toothbrushes is that they do not provide an efficient surface for brushing the surfaces of each tooth. Most brushes provide a flat brushing surface which does not effectively contact the contours of the tooth surface. One prior art device, U.S. Pat. No. Des. 97,360 (Stevens), provides an elongated concave brush surface, but this surface would be effective only if aligned vertically with each tooth being brushed. Such positioning is awkward at best, and impossible for teeth in the back of the mouth.

It has also been suggested to shape the brushes of a standard toothbrush to a point to provide a pick for cleaning between the teeth, U.S. Pat. No. 2,155,245 (Sekine). However, this pick has the previously-mentioned disadvantages of brushes on elongated handles and further, no surface is provided for efficiently brushing the surfaces of each tooth.

It has also been suggested to provide a rubber tip on the end of a tongue toothbrush for massaging the gums, and a slit storage compartment and mounting projection for a length of dental floss, U.S. Pat. No. 4,292,705 (Stouffer).

SUMMARY OF THE INVENTION

It is an object of this invention to provide a finger-mounted device for cleaning teeth having a teeth cleaning surface shaped to complement the contours of a tooth for efficient cleaning of the surfaces of the tooth.

A further object is to provide a finger-mounted device for cleaning the teeth which is held securely on the finger and which is economical to manufacture.

Another object is to provide a finger-mounted device having both a soft bristle surface for cleaning the surfaces of the teeth and a hard bristle portion forming a point for use as a pick for cleaning between the teeth.

Still another object is to provide a finger-held device for cleaning teeth including a length of dental floss secured at one end to the device.

According to the invention, there is provided a finger-mounted device for cleaning teeth having a holder means for engaging a finger and teeth cleaning means mounted on the holder means. The teeth cleaning means has an improved cleaning surface comprising a plurality of concave surfaces joined along raised edges, each of the concave surfaces being adapted to clean a complementary shaped convex tooth surface and the raised edges being adapted to clean the tooth edges. Preferably, the teeth cleaning means is a brush.

In another aspect of the invention a finger-mounted teeth cleaning device is provided consisting of holder means for engaging a finger, brush means comprising an area of soft bristles extending from the holder means, the distal ends of the soft bristles defining the teeth cleaning surface for brushing the surfaces of a tooth by the application of the first force, and pick means comprising a section of hard bristles disposed within the soft bristle area, the distal ends of the hard bristles being tapered to form a point lying below the teeth cleaning surface to form a pick for cleaning between the teeth when a second pressure greater than the first pressure is applied. Preferably the teeth cleaning surface comprises a plurality of concave surfaces (four such surfaces being most preferable) joined by raised edges and the pick means is disposed beneath one of the raised edges.

In another aspect, the invention comprises a nonslip finger mounted device for cleaning teeth consisting of a tubular holder having a first edge defining a first open end through which a finger is inserted into the holder and a second edge defining a second open end through which the fingernail extends, the second edge having an arcuate portion defining a concave fingertip surface on the interior of the holder adapted to engage the palm side of the fingertip for retaining the holder on the finger, and teeth cleaning means on the palm side of the holder. Preferably the tubular holder is made of a resilient material such as silicone rubber.

In another aspect, there is provided a teeth cleaning device including a length of dental floss attached at one end to the device and stored around a spool attached to the device, the opposite end of the floss being attached to ring means which is also mounted on the device but is detachable therefrom for unwinding the floss from the spool and holding the floss taut between the ring means and device in a teeth flossing position.

BRIEF DESCRIPTION OF THE DRAWING

The above and other features, objects and advantages of the present invention will be better understood from a reading of the detailed description of the preferred embodiment in conjunction with the following drawing in which.

DETAILED DESCRIPTION OF THE PREFERRED EMBODIMENT

Figure 1:
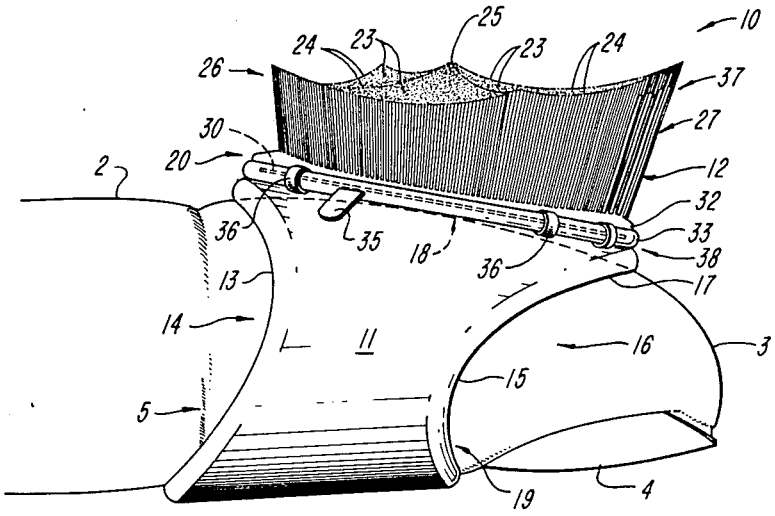
FIG. 1 is a perspective view of a preferred embodiment of the teeth cleaning device of this invention.

FIG. 1 shows a preferred embodiment of the teeth cleaning device 10 of this invention. Device 10 includes a holder means 11 for engaging a finger and teeth cleaning means 12 mounted on the holder.

According to one aspect of the invention an improved nonslip holder means 11 is provided. The holder means consists of a tubular member or band 11 which is open at both ends and having a bore 19 adapted to engage a finger 2. In the preferred embodiment shown bore 19 engages the finger distal of the first finger joint 5. Tubular member 11 has a first edge 13 defining a first open end 14 through which finger 2 is inserted. A second edge 15 defines a second end 16 through which fingernail 4 extends. Second edge 15 includes an arcuate portion 17 extending around the palm side of fingertip 3 of define a longitudinally and transversely extending concave fingertip surface or seat 18 on the interior of tubular member 11 located between the first and second edges 13, 15. Concave surface 18 is adapted to engage the palm side of the fingertip for securing device 10 to the finger. The palm side of the fingertip lies on the palm side of the hand, as opposed to the fingernail which lies on the back side of the hand. Preferably, tubular member 11 is bias cut to further improve the adherence of holder means 11 to finger 2, and a padded area 38 is provided above concave surface 18 to distribute the forces transmitted between teeth cleaning means 12 and fingertip 3.

Tubular member 11 may be made of any nontoxic material which retains its strength when wet such as plastic, fabric, or waterproof paper. Preferably tubular member 11 is made flexible and resilient, consisting of a thin band of a material selected from the group consisting of silicone rubber, natural or synthetic rubber, vinyl resins, polyethylene, and the like. Especially preferred are elastomeric materials such as silicone rubber. The tubular member 11 is preferably of from about one to about two mm (milimeters) in thickness.

The teeth cleaning means 12 is mounted on the palm side of the tubular member 11. Preferably, a pad 20 which is thicker and less flexible than tubular member 11 is provided for mounting the teeth cleaning means 12 and distributing the forces transmitted through means 12. Pad 20 may be integral with or attached to tubular member 11. Preferably, pad 20 is from about two to about three mm in thickness. Pad 20 may be made of any soft material which is nontoxic and preferably is made of the same material as tubular member 11. Padded area 38 may be part of pad 20.

The improved teeth cleaning means 12 of this invention defines a teeth cleaning surface 22 having a plurality of concave surfaces or sectors 23 joined along raised edges 24. The concave surfaces 23 are shaped to complement the convex surfaces of a tooth, the raised edges 24 facilitating cleaning along the edges of the tooth. During brushing a circular motion should be used and a sector 23 positioned over a tooth. The concave shape of sectors 23 permits effective cleaning of rear teeth surfaces while holding the finger substantially horizontal (perpendicular to the tooth axis). By providing a plurality of sectors more than one sector may be positioned over a respective tooth to allow simultaneous brushing of a plurality of teeth. Further, proper alignment of a sector over a tooth is more readily achieved.

Preferably teeth cleaning means 12 comprises a brush. Brush 12 preferably defines four concave surfaces 23 joined along four raised edges 24 and meeting in the center at a raised point 25. The bristles of brush 12 can be made of any known toothbrush bristle material such as nylon.

In another aspect of the invention teeth cleaning means 12 includes an area of soft bristles 26 defining a tooth-cleaning surface and a pick means 27 consisting of a section of hard bristles disposed within the soft bristle area 26, the distal ends of the hard bristles being tapered in a direction away from the holder means 11 to form a point 37 which lies below the teeth cleaning surface. Preferably the teeth cleaning surface consists of a plurality of concave surfaces 23 joined along raised edges 24 and hard bristle section 27 is disposed beneath one of raised edges 24 and more preferably adjacent an edge of brush area 26 near fingertip 3. By providing point 37 within and just below the teeth cleaning surface of soft bristles 26, both pick means for cleaning between teeth and brush means for cleaning the surfaces of teeth may be provided on a single device 10 in such a manner that neither interferes with the action of the other. Thus, by applying a light pressure to pad 20, the soft bristles 26 will effectively engage the teeth surfaces for effective surface cleaning while the application of a slightly greater force will push aside the soft bristles 26 so that hard bristles 27 may be used as a pick between the teeth. Point 37 is preferably disposed from about four to about five mm below surface 24.

Figure 2:
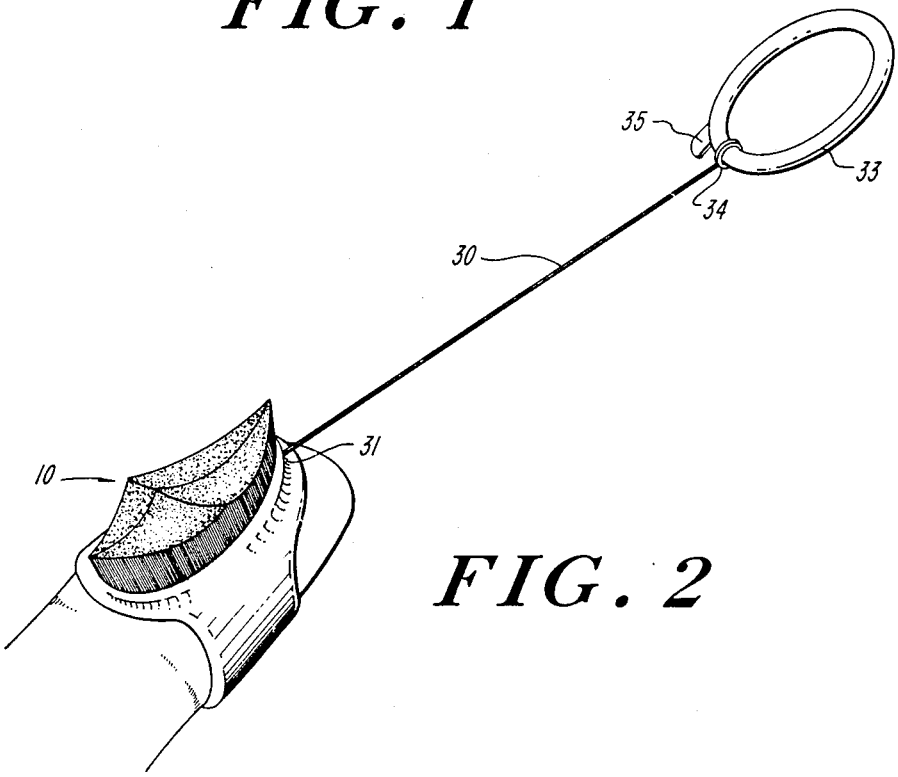
FIG. 2 is a perspective view of the device of FIG. 1 wherein the ring means is detached from the device and the floss is extended taut between the device and ring means in a teeth flossing position.

According to another aspect of this invention, device 10 includes a length of dental floss 30 having a first end 31 attached to device 10. Floss 30 is wrapped around a spool means 32 attached to device 10 for storage of the floss. A ring means 33 is attached to a second end 34 of floss 30, ring means 33 being mounted on device 10 when storing floss 30 and being detachable from device 10 for unwinding floss 30 and extending the floss taut between ring means 33 and device 10 in a teeth flossing position as shown in FIG. 2. Preferably ring means 33 includes a tab 35 to facilitate gripping the ring while removing it from the device. Ring means 33 is preferably mounted over spool means 32 and may be temporarily retained on device 10 by means of breakable strips 36. For example, a two foot length of floss 30 is adequate for flossing and may be wound around spool 32 without adding unnecessarily to the bulk of device 10.

Having described the invention in detail, those skilled in the art will appreciate that numerous modifications may be made thereof without departing from the spirit of the invention. Therefore, it is not intended that the scope of the invention be limited to the specific embodiment as illustrated and described herein. Rather, it is intended that the scope of the invention be determined by the appended claims and their equivalents.

What is claimed is:

1. An improved finger-mounted device for cleaning teeth of the type having holder means for engaging a single finger and teeth cleaning means mounted on said holder means, wherein the improvement comprises:

said holder means being tubular and capable of enclosing a single finger, and said teeth cleaning means having a cleaning surface comprising a plurality of concave surfaces joined along raised inner edges and bounded by raised outer edges, each of said concave surfaces being adapted to clean a complementary shaped convex tooth surface and at least pairs of said raised outer edges meeting at raised points located at spaced intervals along the perimeter of said cleaning surface and being adapted to clean the tooth edges.

2. The device of claim 1 wherein said teeth cleaning means comprises a brush.

3. The device of claim 2 wherein said cleaning surface comprises four concave surfaces joined along four raised inner edges which meet in the center at a raised point and bounded by four raised outer edges.

4. A finger-mounted device for cleaning teeth comprising:

holder means for engaging a finger;

brush means comprising a single area of soft bristles of substantially uniform bristle density extending from said holder means, the distal ends of the said soft bristles defining a teeth cleaning surface for brushing the surfaces of a tooth by the application of a first force;

pick means comprising a single cluster of hard bristles disposed entirely within said soft bristle area, the distal ends of said hard bristles being tapered to form a point, the tapering of said hard bristles extending in a direction away from said holder, and said point lying below said teeth cleaning surface to form a pick for cleaning between teeth when a second pressure greater than said first pressure is applied.

5. The device of claim 4 wherein said teeth cleaning surface includes a plurality of concave surfaces joined by raised edges and said pick means is disposed beneath one of said raised edges.

6. The device of claim 5 wherein said pick means comprises a single cluster of bristles disposed adjacent the edge of said soft bristle area.

7. A nonslip finger-mounted device for cleaning teeth comprising:

a tubular holder having a first edge defining a first open end through which a finger is inserted into said holder and a second edge defining a second open end through which the fingernail extends, said second edge having an arcuate portion the interior surface of the holder located between said first edge and said second edge defining a longitudinally and transversely extending concave surface adapted to engage the palm side of the fingertip for retaining said holder on the finger; and teeth cleaning means mounted on the palm side of said tubular holder.

8. The device of claim 7 wherein said tubular holder includes a padded area above said concave surface.

9. The device of claim 8 wherein said tubular holder and padded area are integral and are made of a resilient material.

10. The device of claim 9 wherein said resilient material is silicone rubber.

11. The device of claim 7 wherein at least one of said first and second edges is bias cut.

* * * * *